United States Patent [19]

Refabert

[11] Patent Number: 4,717,363

[45] Date of Patent: Jan. 5, 1988

[54] DOLLS OR SIMILAR TOYS

[75] Inventor: Jacques Refabert, Saint Cyr S/Loire, France

[73] Assignee: Ets Anselme S.A., Langeais, France

[21] Appl. No.: 891,519

[22] Filed: Jul. 29, 1986

[30] Foreign Application Priority Data

Jul. 30, 1985 [FR] France ..... 85 11612

[51] Int. Cl.[4] ..... A63H 3/28

[52] U.S. Cl. ..... 446/14; 434/266; 434/267; 446/175

[58] Field of Search ..... 446/14, 175, 297, 302, 446/303; 434/265, 266, 267

[56] References Cited

U.S. PATENT DOCUMENTS 3,162,980 12/1964 Hellman ..... 446/302
3,274,729 9/1966 Refabert ..... 446/175 X
4,605,380 8/1986 Camm et al. ..... 446/14

FOREIGN PATENT DOCUMENTS 1388852 1/1965 France .

*Primary Examiner*—Kenneth J. Dorner
*Assistant Examiner*—James R. Brittain
*Attorney, Agent, or Firm*—Townsend and Townsend

[57] ABSTRACT

The invention relates to a doll equipped with a voice or sub-assembly supplied by an electric battery and adapted to emit sounds such as those accompanying the tears of a baby. This doll comprises in addition an infra-red radiation detector incorporaed close to one of the cheeks of the doll so as to be sensitive to the heat radiated by a child placed in the immediate proximity of this cheek. This detector is associated with exploitation means so that any emission of sounds by the doll is neutralized as soon as the heat power received by the detector exceeds a predetermined threshold.

3 Claims, 2 Drawing Figures

DOLLS OR SIMILAR TOYS

BACKGROUND OF THE INVENTION

The invention relates to dolls or other toys, such as plush animals, representing living creatures which can emit sounds, these toys being designated in the following by the word "dolls" in the interest of simplification and without being limiting.

It is directed more particularly, among these dolls, to those which are equipped with a "voice" or sub-assembly supplied by an electric battery and adapted to emit sounds such as those accompanying a baby's tears.

The dolls concerned generally comprise an electrical switch accessible from the outside of the doll and mounted in the electrical lead which connects the battery to the voice: closing and opening this switch has the effect of actuating the emission and the arrest respectively of the sounds.

In an improved doll of the type indicated, it has already been proposed to servo-couple the actuation of the above described switch to the variation in intensity of infra-red rays received by a cell sensitive to such radiation and mounted on the doll.

However the cell concerned was then designed and arranged so that the proximity of a heat source triggered the voice of the doll instead of stopping it.

In other words, the doll concerned started to cry as if it was burning or as if it was too hot when an intense heat source came near to it.

The object sought by the present invention is totally different since the latter no longer proposes to trigger crying or tears, but on the contrary to cause them to cease.

More generally the purpose of the present invention is to render such, the dolls concerned, that they are more attractive than those at present known for children who play with them in the sense that the cessation of the tears of these dolls can be controlled automatically by one of the natural gestures performed by these children in order to console their dolls, said gesture consisting for the child of kissing or fondling the head of the doll, particularly on the cheek or on the forehead.

GENERAL DESCRIPTION OF THE INVENTION

Accordingly, the dolls according to the invention comprise also, in manner known in itself, an infra-red radiation detector and exploitation means, comprising an electrical switch, adapted to act automatically on the voice as soon as the intensity of the detected radiation exceeds a predetermined threshold, and they are essentially characterized in that the detector is placed in the head of the doll close to an area of the outer surface of this head and in that the detector and the exploitation means are selected and arranged so that the heating of the detector due to the simple contact of a portion of the human body with the above area has the effect of opening the switch and hence of placing the voice out of circuit.

The above area is advantageously one of the cheeks of the doll or the forehead of this doll.

The invention comprises, apart from these main features, certain other features which are preferably used at the same time and which will be more explicitly considered below.

In the following, a preferred embodiment of the invention will be described with reference to the accompanying drawing to be considered of course as non-limiting.

GENERAL DESCRIPTION OF THE DRAWINGS

DESCRIPTION OF A PREFERRED EMBODIMENT

Figure 1:
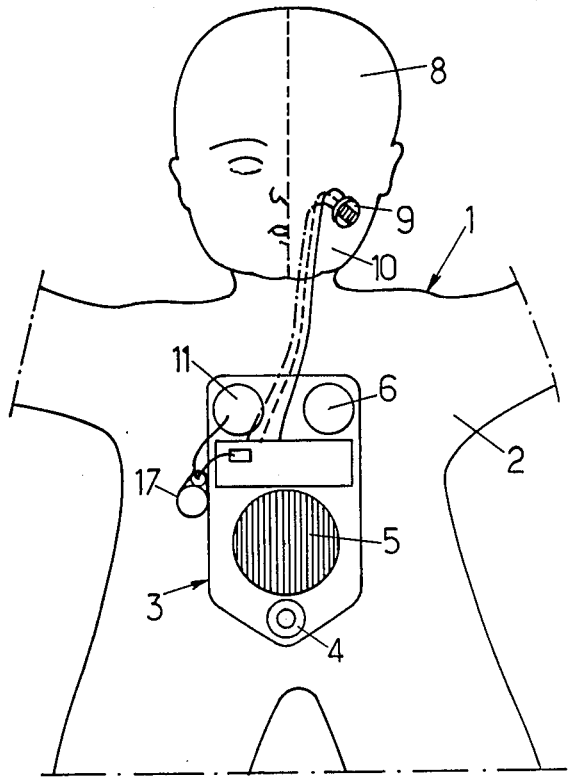
FIG. 1 shows a diagrammatic view of an improved doll according to the invention.
Figure 2:
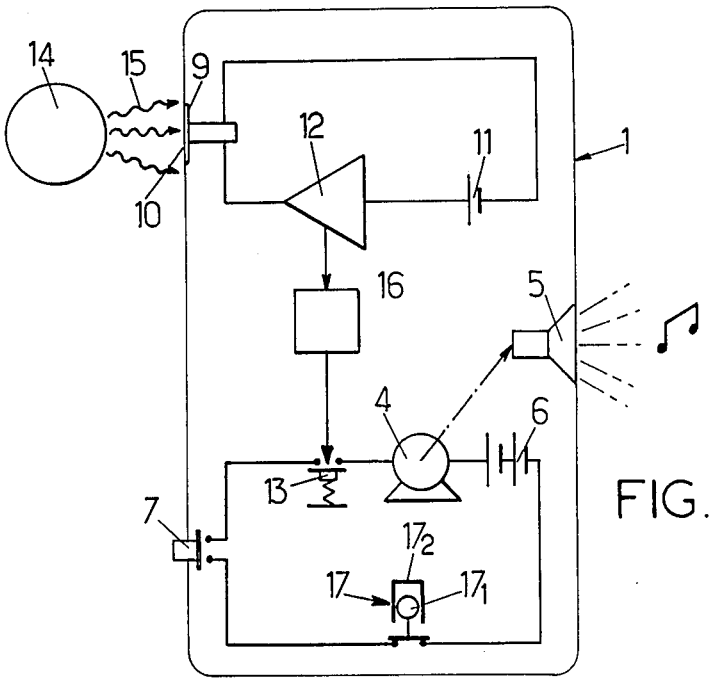
FIG. 2 is an explanatory diagram of this improvement.

In manner known in itself, the doll 1 comprises, housed in its body 2, a "voice" 3, that is to say a device adapted to emit, when it is energized electrically, sounds such as those accompanying the tears of a newborn baby.

This voice 3 comprises, for example, an electrical motor 4 adapted to drive a phonograph whose loud speaker is visible at 5, said motor being supplied by electrical batteries 6 on the closing of switch 7 whose control member is actuatable from outside the doll, this member being particularly placed in the back of this doll.

In addition, in accordance with the invention, there is provided in the head 8 of the doll, an infra-red detector 9 positioned just behind a cheek 10 of the doll.

This detector 9, of the passive type, is associated with an electrical battery 11 and with an amplifier 12 arranged so as to form signals adapted to actuate switch 13 mounted between the battery 6 and the voice 4–5.

The detector 9 is selected to be fairly sensitive and the amplifier 12, fairly powerful so that heat radiation due to contact, with the cheek of the doll, of a portion of human body such as the mouth or the hand of a child 14 has the effect of generating, at the output of the amplifier 12, a signal adapted to open the switch 13.

The operation of the unit is then as follows.

At rest, the switch 13 is closed and the switch 7, opened.

On the closing of the switch 7 by the child 14 playing with the doll, the voice 4–5 is energized and the doll breaks into tears emitting cries or sobs.

If, under these conditions, the child 14 kisses its doll on the cheek or caresses its cheek with its hand, the detector 9 receives the heat radiation 15 emitted by the child and when the intensity of this radiation 15 exceeds predetermined threshold S, the amplifier 11 emits a signal adapted to open switch 13.

The electrical energization of the voice is then interupted and the weeping of the doll ceases.

This result, achieved without the child having to actuate by itself any switch, is of such a nature as to make it think that its doll ceases to cry because it has been consoled by a bestowed kiss or caress.

This interuption of crying of the doll can be definite, its resumption requiring then a restarting of any desirable nature.

In a preferred embodiment illustrated, there is provided a delay circuit 16 associated with the amplifier 12 so that the actuating signals of the switch 13 emitted by this amplifier as soon as the threshold S is passed become automatically neutralized after a predetermined delay R consecutive to the beginning of this passage.

After this delay, which is, for example, comprised between 10 seconds and one minute and is preferably of the order of 30 seconds, the weeping of the doll recommences and the child must again console it to calm it.

According to another improvement also illustrated, there is provided between the batteries 6 and the voice 4–5, in series with the two switches 7 and 13, a third switch 17 sensitive to gravity.

This switch 17 is, for example, closed by a metal ball $17_1$ housed in a tube $17_2$ when the doll is laying on its back and on the contrary open for other positions of the doll, and in particular for those corresponding to its sitting position or laying on its belly, the ball $17_1$ then being spaced from the electrical contact of the switch and being driven by gravity towards the end of the tube $17_2$, furthest from said contact.

This opening of the switch 17 takes the relay of successive openings of the switch 13, which allows the doll to be calmed lastingly after a series of consolations of this doll due to the simple thermal reconciliations of the child.

After an interuption ensured by such an opening of the switch 17, the resumption of the game is automatically ensured by replacing the doll in its position laying on its back.

As a result of which, and whatever the embodiment adapted, there is provided finally a crying doll whose constitution, operation and advantages result sufficiently from the foregoing.

As is self-evident, and as results besides already from the foregoing, the invention is in no way limited to those of its types of application and embodiments which have been more especially envisaged; it encompasses, on the contrary, all modifications.

What is claimed is:

1. A toy comprising a doll body including a head with facial surface and an electrical circuit for generating the sound of a crying baby through a speaker, the improvement comprising an infrared radiation detector located immediately below said facial surface to receive heat emitted by a heat source in close proximity to said facial surface, said infrared detector generating a first electrical signal, an amplifier means coupled to and activated by said first electrical signal for generating a second electrical signal in response to said detector generated first electrical signal when infrared radiation exceeds a threshold level, and a switch means coupled to and activated by said second electrical signal for interrupting said electrical circuit and the generation of said sound through said speaker.

2. A toy in accordance with claim 1 and further characterized by means for delaying the restoration of said sound until a predetermined delay R.

3. A toy in accordance to claim 2, wherein said delay R is between 10 and 50 seconds.

* * * * *